US007055688B2

(12) United States Patent
Watson et al.

(10) Patent No.: US 7,055,688 B2
(45) Date of Patent: Jun. 6, 2006

(54) HINGED JEWEL CASE

(75) Inventors: Dan E. Watson, Fergus Falls, MN (US); Gregory D. Roberts, Breckenridge, MN (US)

(73) Assignee: Imation Corp., Oakdale, MN (US)

( * ) Notice: Subject to any disclaimer, the term of this patent is extended or adjusted under 35 U.S.C. 154(b) by 373 days.

(21) Appl. No.: 10/325,314

(22) Filed: Dec. 19, 2002

(65) Prior Publication Data

US 2004/0118716 A1 Jun. 24, 2004

(51) Int. Cl.
*B65D 85/30* (2006.01)
*B65D 85/57* (2006.01)

(52) U.S. Cl. ..... 206/308.1; 206/309; 220/836

(58) Field of Classification Search ..... 206/308.1, 206/307, 308.3, 387.1, 387.12, 232, 309–313, 206/387.13, 472; 220/23.4, 836, 840
See application file for complete search history.

(56) References Cited

U.S. PATENT DOCUMENTS 4,928,816 A * 5/1990 Zusy ..... 206/232
5,890,590 A * 4/1999 Doodson ..... 206/308.1
5,938,021 A * 8/1999 Grobecker ..... 206/308.1
6,000,537 A * 12/1999 Doodson ..... 206/232
6,000,541 A * 12/1999 Yu ..... 206/308.1
6,119,857 A * 9/2000 Stumpff ..... 206/308.1
6,334,268 B1 * 1/2002 Ikebe et al. ..... 206/310
6,530,474 B1 * 3/2003 Rufo et al. ..... 206/308.1
2003/0024832 A1 * 2/2003 Kwok-Din ..... 206/308.1

* cited by examiner

*Primary Examiner*—Bena Miller
(74) *Attorney, Agent, or Firm*—Eric D. Levinson

(57) ABSTRACT

A jewel case (30) has a first housing section (31) and a second housing section (32) hinged to the first housing section (31). Two boxed hinge members (38, 39) are operatively connected to the first housing section (31). The second housing section (32) has first and second posts (51) adapted and configured to be positioned in bores (41*a*). The bores have perimeters sufficiently greater than 180 degrees, wherein the posts (51) enter the bores (51*a*) generally along the axis of the bores (41*a*). The second housing section (32) has a stop member which limits opening to substantially 180 degrees.

15 Claims, 8 Drawing Sheets

HINGED JEWEL CASE

BACKGROUND OF THE INVENTION

1. Field of the Invention

This invention concerns packaging for recording media, and more particularly to a jewel case having a post and socket hinge.

2. Description of the Prior Art

In addition to the traditionally insatiable demand of consumers for inexpensive and inexhaustible data storage, data recording and electronic playback systems must also satisfy consumer demand for portability of systems and media, and vendor demands for packaging that effectively promotes sales without encouraging loss of inventor by way of theft. One successful example of commercially successful packaging is the conventional jewel case in which many forms of disc-based recording media are shipped, stocked, and sold. It accommodates conventionally sized 120 mm diameter media such as CD (Compact Disc), DVD (Digital Versatile Disk) and the like.

A drawback of the present jewel case is that it is relatively rigid and easily breaks. The designs are such that if the cases are not easily broken, they are such that if disengaged, the covers and base are not easily reassembled by a consumer. A first example of a prior art jewel case is shown in FIGS. 1–4 and a second jewel case is shown in FIGS. 5–8. FIG. 1 shows a cover 10 and a base 11 of a typical jewel case. The cover 10 has two tabs 12, 13 which extend from the cover 10. A post 14 extends inwardly from both tabs 12, 13. An enlargement of the post 14 is shown in FIG. 3. FIG. 4 shows an enlargement of the edge of the base 11 that has an opening 11*a* in which the posts 14 are positioned. Lead-in services 11*b*, 11*c* are formed in the side of the base 11 to guide the post 14 into position so that they may be engaged in the opening 11*a*. The jewel case which utilizes the cover 10, base 11 does have a more secure fit because of the post and socket assembly. However, the tabs 12, 13 are more easily broken and further the cover 10 may be opened more than 180 degrees, which will put additional stress on the tabs and further the chances of breaking.

Another design of a prior art jewel case is shown in FIGS. 5–8. The jewel case of this prior art design includes a cover 20 and a base 21. The cover 20 includes two boxed hinges 22, 23. The boxed hinge 22 has an end wall 22*a* which is spaced from the edge by two side walls 22*b*, 22*c*. A post 24 extends inward from the boxed hinges 22, 23. As can be seen in FIG. 5, there is no material or portion of the cover 20 that extends between the boxed hinges 22, 23. The base 21 includes a pair of slots 21*a* that are adapted and configured to receive the post 24. The lead-in edges 21*b* provide for a guided path for the post 24 to form their snap fit into the slot 21*a*. However, the open top configuration of the slot allows for the post 24 to more easily become disengaged. Further, the cover may again rotate more than 180 degrees from the base 21, thereby causing additional chances for breakage or disengagement.

The present invention addresses the problems associated with the prior art jewel cases.

SUMMARY OF THE INVENTION

In one embodiment, the invention is a jewel case for housing at least one piece of recording media. The jewel case includes a first case housing section and a second case housing section hinged to the first case housing section. The first case housing section has a planar member having a first end, a second end, a first side and a second side. A first boxed hinge member is operatively connected to the planar member proximate the first end and the first side. A second boxed hinge member is operatively connected to the planar member proximate the first end and second side. The planar member extends between the boxed hinges. Each boxed hinge has an end member having a bore formed therein, the bore having an axis. The second case housing section has first and second posts, the posts adapted and configured to be positioned in the bores, whereby the second case housing section is hinged to the first case housing section. The bores have a perimeter sufficiently greater than 180 degrees, wherein the posts enter the bores generally along the axis of the bores. The second case housing section has a stop member positioned between the posts, wherein when the second case housing section is moved to an open position, the stop member contacts the planar member, limiting opening to substantially 180 degrees.

In another embodiment, the invention is a jewel case for housing at least one piece of recording media. The jewel case includes a first case housing section and a second case housing section hinged to the first case housing section. The first case housing section has a planar member having a first end, a second end, a first side and a second side. A first socket member is operatively connected to the planar member proximate the first end and the first side. A second socket member is operatively connected to the planar member proximate the first end and second side, the planar member extending between the socket members. Each socket member having a bore formed therein, the bores having an axis. The second case housing section has first and second posts, the posts adapted and configured to be positioned in the bores, whereby the second case housing section is hinged to the first case housing section. The second case housing section has a stop member positioned between the posts, wherein when the second case housing section is moved to an open position, the stop member contacts the planar member, limiting opening to substantially 180 degrees.

DETAILED DESCRIPTION OF A PREFERRED EMBODIMENT

Figure 3:
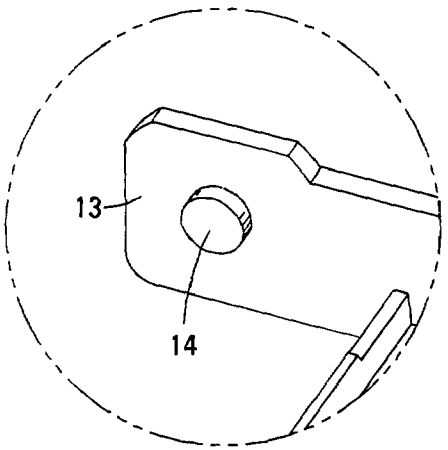
Fig. 3 Prior Art
FIG. 3 is an enlarged perspective view of a portion of the cover shown in FIG. 1 taken at 3.

Referring to the drawing, wherein like numerals represent like parts throughout the several views, there is generally disclosed at 30 a jewel case. The jewel case 30 provides a packaging scheme in which one or more pieces of recorded media are contained within a single package having the conventional jewel case form factor. The form factor of the recording media pieces may be sufficiently small enough for several individual pieces of media to be held within the conventional jewel case, if desired. It is understood depending upon the size of the media, one media piece or up to five media pieces or even more, if their size permits, could be packaged into the jewel case 30.

The jewel case 30 has a top cover 31 which is hinged to a base 32. The cover 31 pivots between an open position in which the contents of the jewel case 30 are accessible and a closed position in which they are not. While deviations are possible, the preferred embodiment is the same or approximately the same dimensions as the conventional "10 mm" jewel case, i.e., a shallow rectangular box measuring approximately 140 mm wide, 125 mm high and 10 mm in thickness when closed. It is understood that the designations, cover and base are arbitrary and, if looked at differently, could be reversed. In any event, the cover 31 and base 32 are two sections of housing that combine to form the jewel case 30.

The cover 31 has four tabs 33 that are preferably integrally molded into the cover 31 in a conventional manner. The number and location of the tabs 33 is not critical to the invention. The tabs are positioned so that a printed sheet or booklet (neither shown) may be placed inside of the cover 31, typically by sliding it under one or more of the tabs 33. The tabs 33 adequately hold a printed sheet or booklet in place without wrinkling or slippage.

The top cover 31 has a generally rectangular planar member 34 which has a first end 34*a*, second end 34*b*, first side 34*c* and second side 34*d*. Side walls 35, 36 are operatively connected to and extend generally perpendicular to the planar member 34 and are located along sides 34*c*, 34*d*. End wall 37 also extends generally perpendicular to the planar member 34 and is operatively connected to the planar member along the second end 34*b*.

Figure 1:
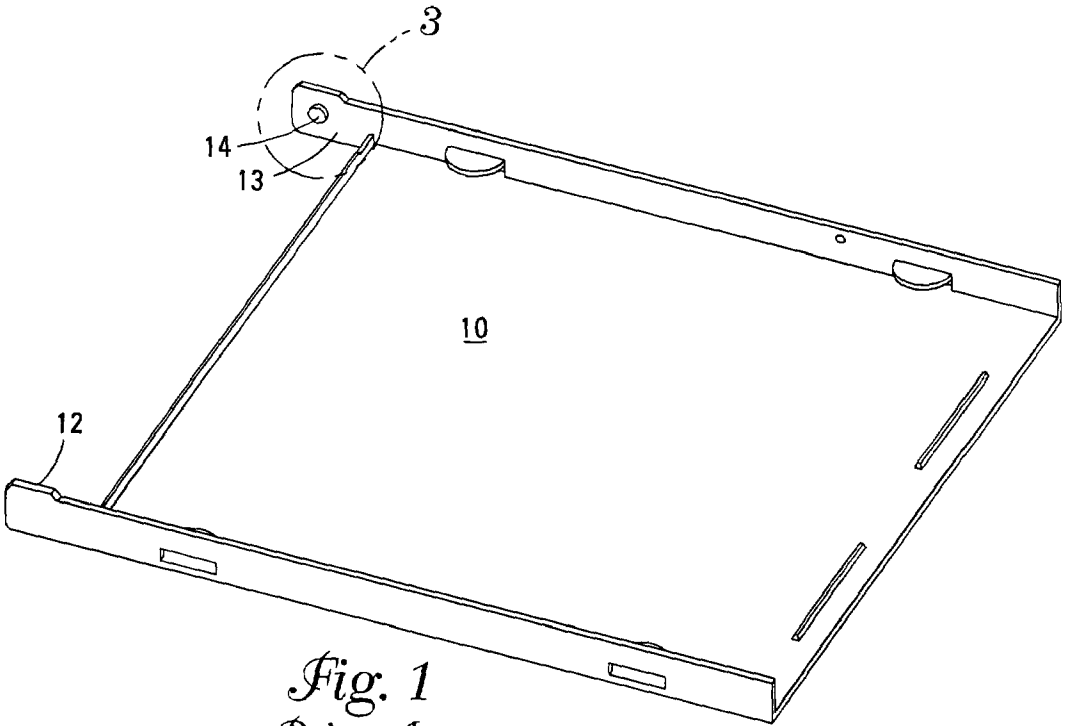
Fig. 1 Prior Art
FIG. 1 is a perspective view of a cover of a prior art jewel case.
Figure 4:
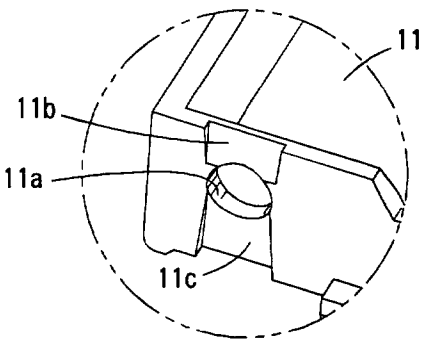
Fig. 4 Prior Art
FIG. 4 is an enlarged perspective view of a portion of the base shown in FIG. 2 taken at 4.
Figure 2:
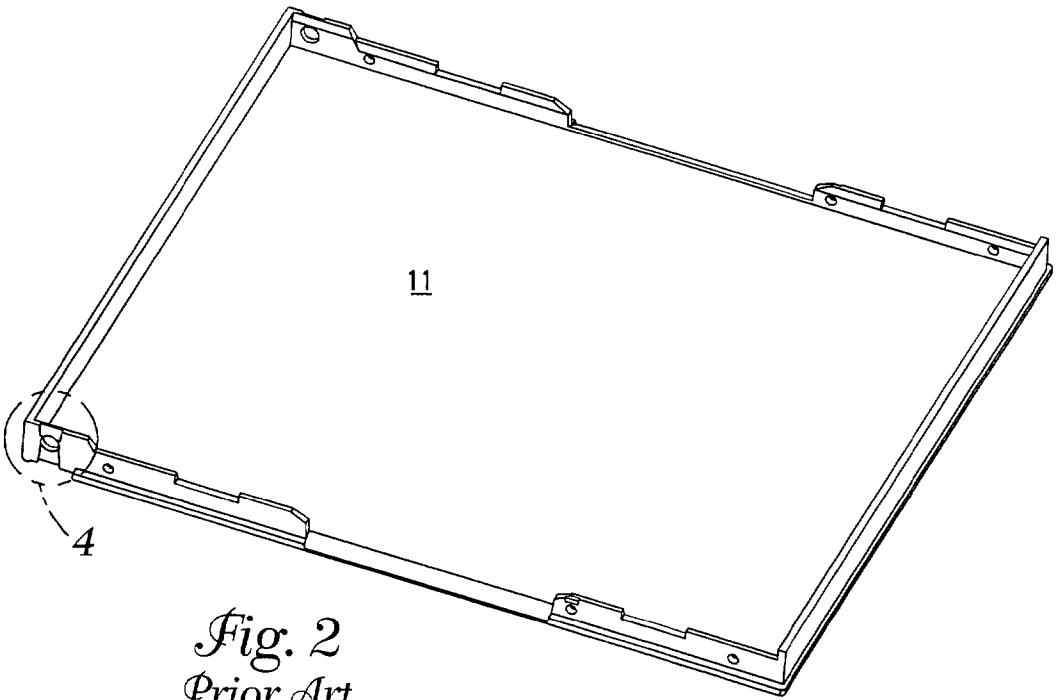
Fig. 2 Prior Art
FIG. 2 is a perspective view of a base for the prior art jewel case shown in FIG. 1.
Figure 7:
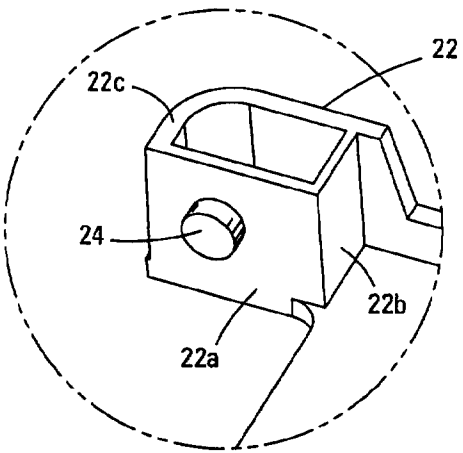
Fig. 7 Prior Art
FIG. 7 is an enlarged perspective of a portion of the cover shown in FIG. 5, taken at 7.
Figure 5:
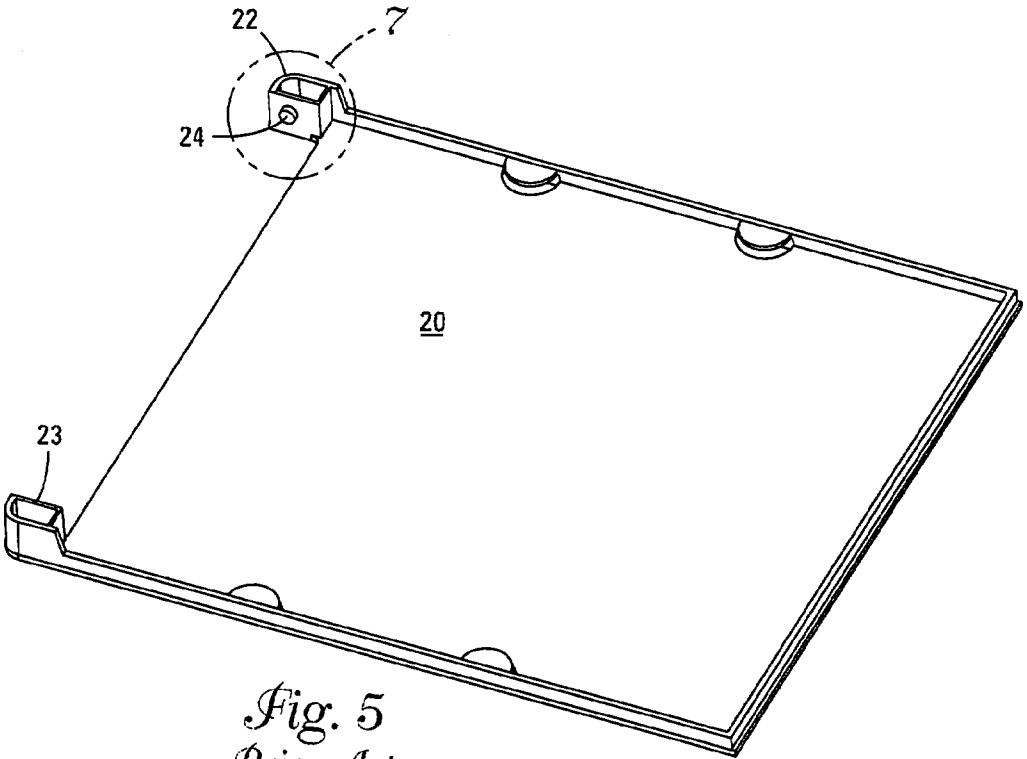
Fig. 5 Prior Art
FIG. 5 is a perspective view of a cover of another prior art jewel case.
Figure 11:
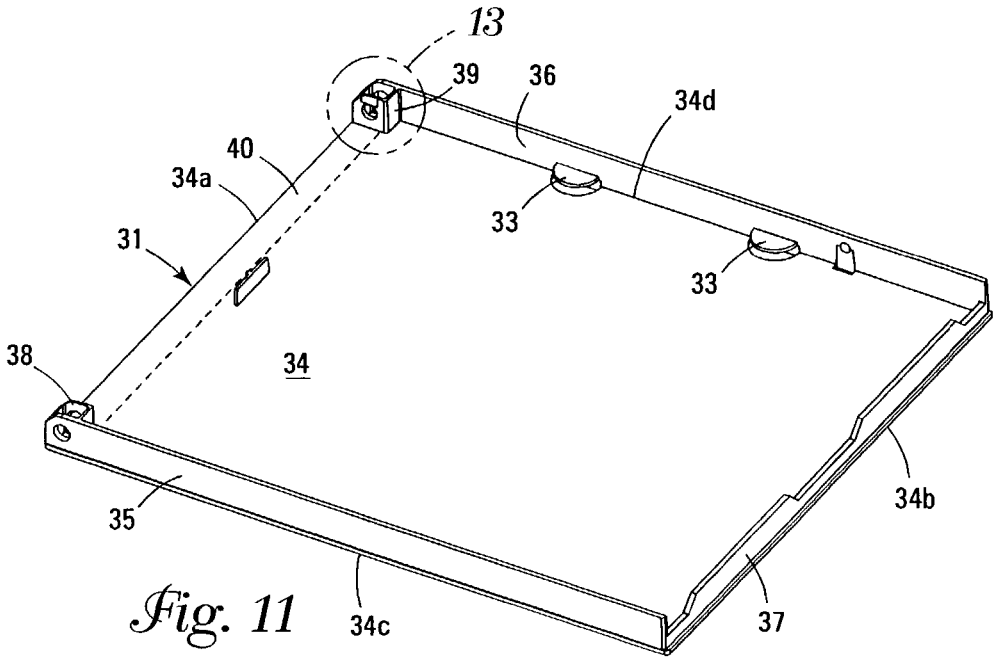
FIG. 11 is a perspective view of a housing section shown in FIG. 9.
Figure 12:
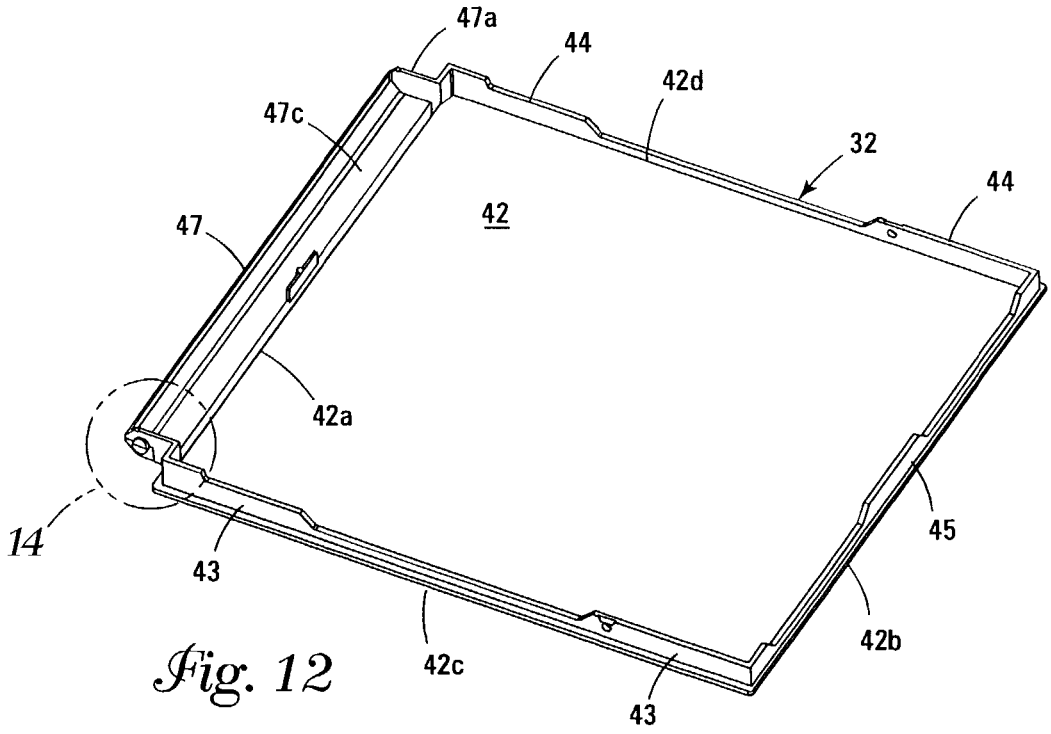
FIG. 12 is a perspective view of another housing section shown in FIG. 9.

Two boxed hinges 38, 39 are operatively connected to the planar member 34 proximate the first end 34*a*. The boxed hinge 38 is proximate the first side 34*c* and the boxed hinge 39 is proximate the second side 34*d*. As can be seen in FIG. 11, the planar member 34 extends between the boxed hinges 38, 39. As will be described in more detail later, that portion of the planar member, which is positioned between the boxed hinges 38, 39, is designated as 40. The section 40 is that portion of the planar member 34 which is between the first end 34*a* and the dashed line, shown in FIG. 11. The dashed line extends from the back edge of box hinge 38 to the back edge of the box hinge 39. This is in contrast to the prior art, shown in FIGS. 1 and 5, wherein there is no cover between the tabs or hinges.

Figure 8:
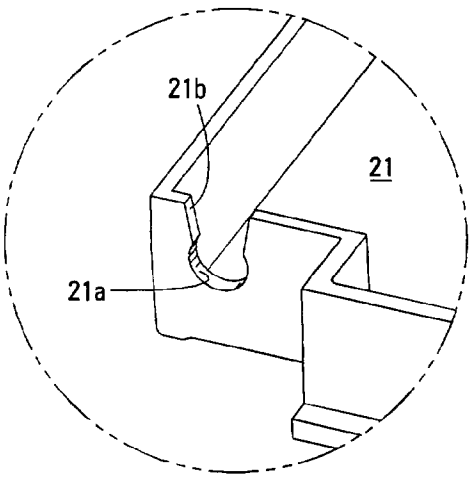
Fig. 8 Prior Art
FIG. 8 is an enlarged perspective view of a portion of the base shown in FIG. 6, taken at 8.
Figure 6:
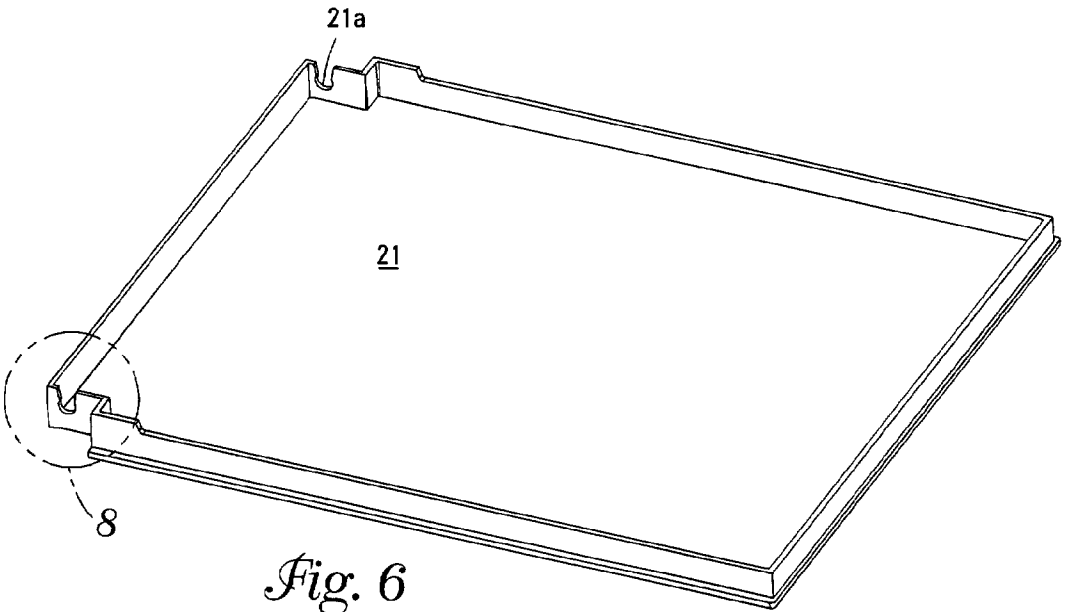
Fig. 6 Prior Art
FIG. 6 is a perspective view of a base for the prior art jewel case shown in FIG. 5.
Figure 13:
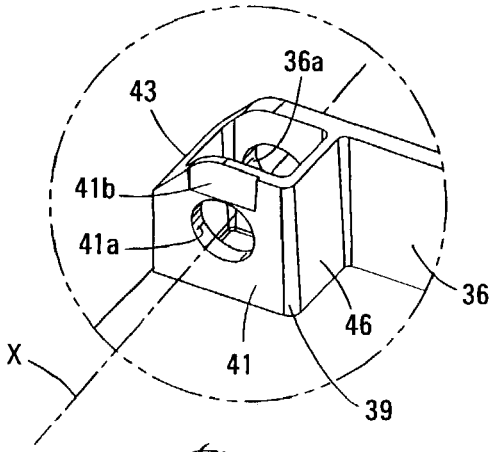
FIG. 13 is an enlarged perspective view of a portion of the housing section shown in FIG. 11, taken at 13.
Figure 14:
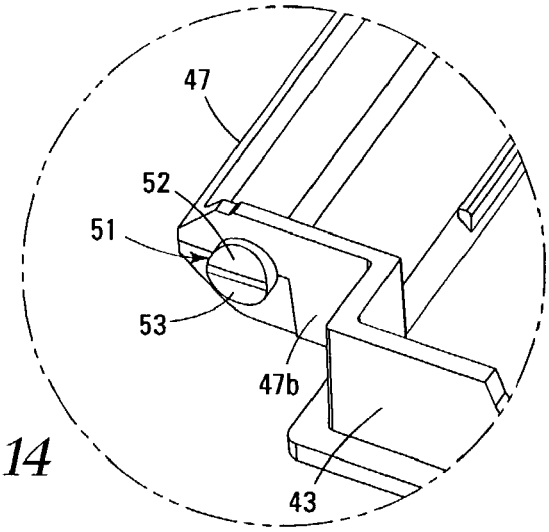
FIG. 14 is an enlarged perspective view of a portion of the housing section shown in FIG. 12, taken at 14.
Figure 15:
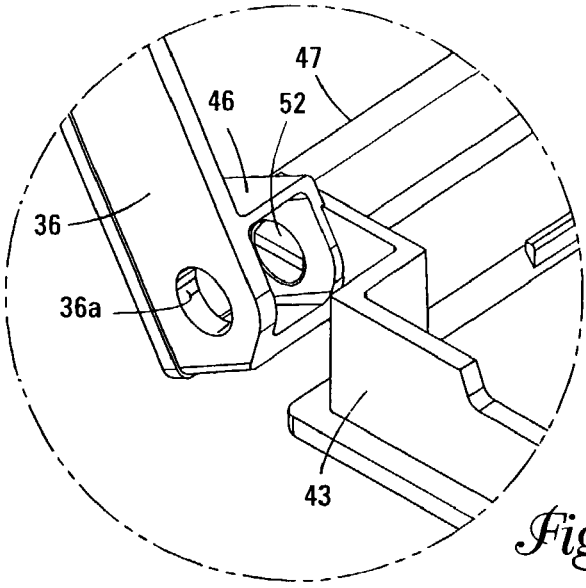
FIG. 15 is an enlarged perspective view of a portion of the jewel case shown in FIG. 9, taken at 15.
Figure 17:
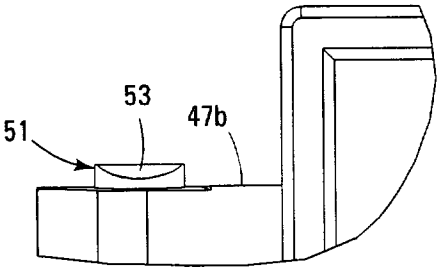
FIG. 17 is a partial side elevational view of the post shown in FIG. 14.
Figure 16:
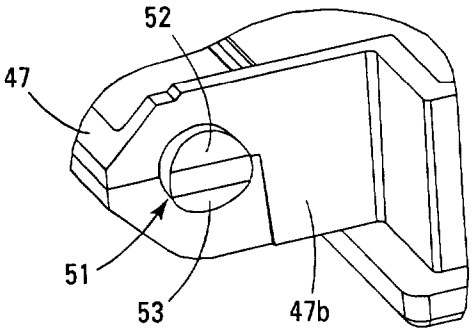
FIG. 16 is an enlarged perspective view of a portion of the invention shown in FIG. 14 viewed from a position lower than shown in FIG. 14.

The boxed hinges 38, 39 are mirror images of each other and accordingly only one will be described in detail. Referring now to FIG. 13, boxed hinge 39 is shown. The boxed hinge 39 has an end wall 41 and two side walls 42, 43 operatively connected to the planar member 34 and side wall 36. An opening 41*a* is formed in the end wall 41 and an opening 36*a* is formed in the side wall 36. The opening 36*a* is present for better molding capabilities. The openings 41*a*, 36*a* are in general alignment about a longitudinal axis X. The opening 41*a* has an outer perimeter in the shape of a circle. The circle forms a closed perimeter, as opposed to the open slot of the prior art shown in FIG. 8. The prior art slot shown in FIG. 8 is slightly more than 180 degrees, but still allows for a post to be inserted with a downward direction and then, after a snap-in fit, is held in place. However, with the prior art, there is always the possibility of the post popping upward and becoming disengaged. While it is not necessary that the opening 41*a* have a completely closed perimeter, as a circle, it needs to be sufficient to allow access of a post (to be described later) only along the longitudinal axis X, and not from above, such as through a slot. An angled surface 41*b* is formed at the top of the end wall 41. The angled surface 41*b* provides for a ramp, as will be discussed more fully hereafter. The angled surface 41*b* is angled such that the top portion of the angled surface 41*b* is closer to the side wall 36 than is the bottom of the angled surface 41*b*, as viewed in FIG. 13. The opening 41*a* in the end wall 41 forms a socket member into which a post is inserted.

The base 32 includes a generally planar member 42. The rectangular planar member 42 has a first end 42*a*, second end 42*b*, first side 42*c* and second side 42*d*. Side walls 43, 44 are operatively connected to and extend generally perpendicular to the planar member 42 and are located along sides 42*c*, 42*d*. End wall 45 also extends generally perpendicular to the planar member 42 and is operatively connected to the planar member along the second end 42*b*.

The base 32 and top cover 31 define an enclosure for holding at least one media. The number of media pieces to be held could vary from one to five or more, depending on the dimensions of both the jewel case 30 and the media pieces. The exact configuration and arrangement of the media pieces is not critical to the scope of the invention.

Figure 18:
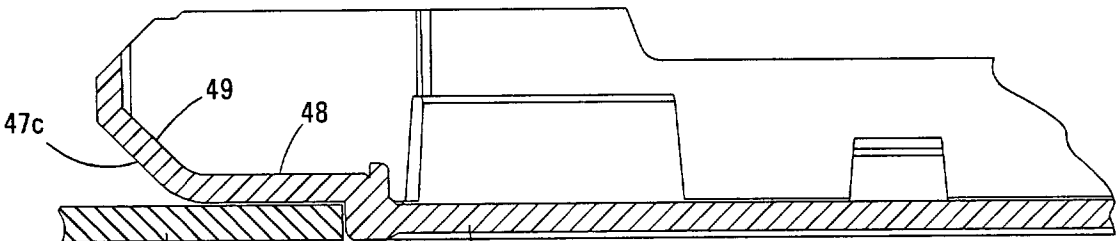
FIG. 18 is a partial cross-sectional view of the jewel case shown in FIG. 10, but in a fully open position.

The base 32 has an elongate hinge member 47. The elongate hinge member 47 has two side walls 47*a*, 47*b* operatively connected by an elongate member 47*c* which, as shown in FIG. 18, has a curved cross section, as shown in FIG. 18. The elongate member 47*c* has a generally planar section 48 and intermediate section 49 and an end portion 50. As can be seen in FIG. 18, the hinge member 47 is operatively connected to and integral with the planar member 42. Each of the side walls 47*a*, 47*b* has a post or pin 51 operatively connected thereto. Only one of the posts 51 is shown, operatively connected to side wall 47*b*, it being understood that a similar post is connected to the side wall 47*a*. The post 51 is generally cylindrical. The free end of the post 51 has an angled section 52 at the top of the post 51 and another angled section 53 at the bottom. The angled sections 51, 52 form a lead-in surface which cooperates with the angled surface 41*b* to aid in assembly. By having two angled sections 52, 53, the cover 31 may be assembled to the base 32 when the cover 31 is directly on top of the base 32, in what would be a closed position, or alternately may be assembled when the cover is 180 degrees from the base 32. The posts 51 are sized and configured to fit in the opening 41*a*, thereby hinging the top cover 31 to the base 32. The pins 51 are of suitable length, such as 1.1 mm, which allows the cover to be inserted by flexing the cover 11 in the base 12. Further, the angled sections 52, 53 aid in the insertion and flexing as they contact the angled surface 41*b*. The overall length of the hinge member 47 is approximately 11.3 cm, including the post 51 which are each 1.1 mm. The distance between the boxed hinges 38, 39 is approximately 11.2 cm. These numbers are illustrative and are for the embodiment shown, it being understood that other lengths could be utilized and not depart from the scope of the present invention. The boxed hinges 38, 39 deflect somewhat as the cover is being inserted, thereby allowing the interference fit of the longer cover into the base. The boxed hinges are resilient, so as to go back to their original shape after being deflected by the insertion of the posts 51. This pin and socket arrangement provides for a secure assembly. The post 51 entered the openings 41*a* generally in the direction of the longitudinal axis X. While the posts do come downward, as viewed in FIG. 13, the angle at which they go into the opening 41*a* is along the longitudinal axis X. Therefore, with not having a slot opening at the top, as in the prior art, the cover is not as likely to become disengaged from the base.

The cover 31 and base 32 are both integrally molded pieces. They may be constructed from any suitable material. In the past, jewel cases have typically been made from polystyrene which may be used for the present invention. However, the jewel case 30 may also be made from a blend of resins which include a first, stiffer resin and a second, more flexible resin, as disclosed in application Ser. No. 10/206,599 filed Jul. 26, 2002, entitled "Jewel Case Having a Resin Blend".

Figures 9, 10:
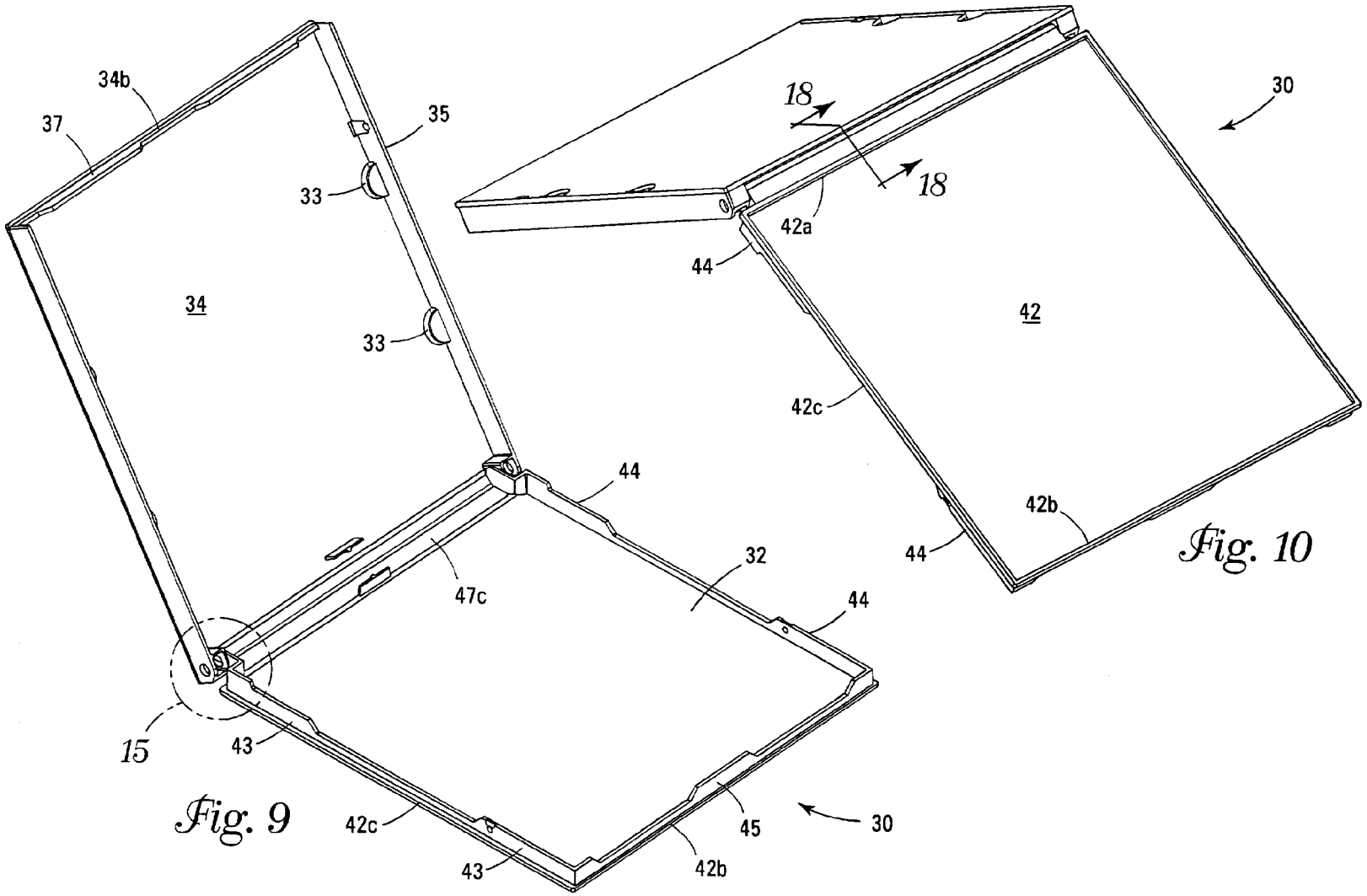
FIG. 9 is a perspective view of a jewel case incorporating the present invention viewed generally from above, with the jewel case in a partially open position.
FIG. 10 is a perspective view of the jewel case shown in FIG. 9, viewed generally from below.

FIGS. 9 and 10 show the jewel case 30 in a partially open position. FIG. 18 shows the jewel case after the cover 31 and base 32 have been extended to the fully open position. In this fully open position, the cover 31 and base 32 are substantially coplanar and they are spaced at approximately 180 degrees from each other. Further rotation, beyond the substantially 180 degrees, is limited when section 40 of the planar member 34 contacts the planar section 48. By not allowing the jewel case 30 to be opened past 180 degrees, additional stress on the hinge connection is minimized, as compared to the prior art. As can be seen in FIG. 18, the planar section 18 is operatively connected to the planar member 42 at a distance which is substantially the same as the thickness of the planar member 34, which further reduces the amount of stress on the hinged connection when the jewel case 30 is in the fully open position. The stresses are then able to be dissipated over a larger area and not concentrated on the hinge joint, as in the prior art.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A jewel case for housing at least one piece of recording media, the jewel case comprising:

a) a first case housing section;

b) a second case housing section hinged to the first case housing section;

c) the first case housing section having a planar member having a first end, a second end, a first side and a second side;

d) a first boxed hinge member operatively connected to the planar member proximate the first end and the first side;

e) a second boxed hinge member operatively connected to the planar member proximate the first end and second side, the planar member extending between the boxed hinges;

f) each boxed hinge having an end member having a bore formed therein, the bore having an axis;

g) the second case housing section having first and second posts, the posts adapted and configured to be positioned in the bores, whereby the second case housing section is hinged to the first case housing section;

h) the bores having a perimeter sufficiently greater than 180 degrees, wherein the posts enter the bores generally along the axis of the bores; and i) the second case housing section having a stop member positioned between the posts, wherein when the second case housing section is moved to an open position, the stop member contacts the planar member, limiting opening to substantially 180 degrees.

2. The jewel case of claim 1, further comprising:

a) the posts having a distal end and the distal end having a first angled surface; and b) the end member of each of the boxed hinges having an inclined surface, wherein assembly is facilitated.

3. The jewel case of claim 2, wherein the posts have a second angled section, wherein assembly is facilitated in two different positions.

4. The jewel case of claim 1, further comprising an elongate hinge member, the posts operatively connected thereto.

5. The jewel case of claim 4, wherein the elongate hinge member is the stop member.

6. The jewel case of claim 5, the second case housing section having a planar member.

7. The jewel case of claim 6, the elongate hinge member being at an elevation offset from the second case housing section planar member.

8. A jewel case for housing at least one piece of recording media, the jewel case comprising:

a) a first case housing section;

b) a second case housing section hinged to the first case housing section;

c) the first case housing section having a planar member having a first end, a second end, a first side and a second side;

d) a first socket member operatively connected to the planar member proximate the first end and the first side;

e) a second socket member operatively connected to the planar member proximate the first end and second side, the planar member extending between the socket members;

f) each socket member having an end member having a bore formed therein, the bore having an axis;

g) the second case housing section having first and second posts, the posts adapted and configured to be positioned in the bores, whereby the second case housing section is hinged to the first case housing section; and h) the second case housing section having a stop member positioned between the posts, wherein when the second case housing section is moved to an open position, the stop member contacts the planar member, limiting opening to substantially 180 degrees.

9. The jewel case of claim 8, further comprising the bores having a perimeter sufficiently greater than 180 degrees, wherein the posts enter the bores generally along the axis of the bores.

10. The jewel case of claim 8, further comprising:

a) the posts having a distal end and the distal end having a first angled surface; and b) the end member of each of the socket members having an inclined surface, wherein assembly is facilitated.

11. The jewel case of claim 10, wherein the posts have a second angled section, wherein assembly is facilitated in two different positions.

12. The jewel case of claim 8, further comprising an elongate hinge member, the posts operatively connected thereto.

13. The jewel case of claim 12, wherein the elongate hinge member is the stop member.

14. The jewel case of claim 13, wherein the second case housing section having a planar member.

15. The jewel case of claim 14, wherein the elongate hinge member being at an elevation offset from the second case housing section planar member.

* * * * *